US008657375B2

(12) United States Patent
LaPointe et al.

(10) Patent No.: US 8,657,375 B2
(45) Date of Patent: Feb. 25, 2014

(54) RESILIENT ROCKING ELEMENT FOR FURNITURE MEMBER

(75) Inventors: Larry P. LaPointe, Temperance, MI (US); Chad E. Adams, Perrysburg, OH (US)

(73) Assignee: La-Z-Boy Incorporated, Monroe, MI (US)

( * ) Notice: Subject to any disclaimer, the term of this patent is extended or adjusted under 35 U.S.C. 154(b) by 837 days.

(21) Appl. No.: 12/759,218

(22) Filed: Apr. 13, 2010

(65) Prior Publication Data

US 2011/0248529 A1 Oct. 13, 2011

(51) Int. Cl.
*A47C 1/035* (2006.01)

(52) U.S. Cl.
USPC ..... 297/258.1; 297/261.1; 297/272.1

(58) Field of Classification Search
USPC ..... 297/261.1, 261.2, 272.1, 272.2, 85 M, 297/271.4, 258.1, 259.1, 463.2, 85
See application file for complete search history.

(56) References Cited

U.S. PATENT DOCUMENTS

| | | | | | |
|---|---|---|---|---|---|
| 203,602 | A | | 5/1878 | Dietsch | |
| 488,911 | A | | 12/1892 | Weber | |
| 569,447 | A | * | 10/1896 | Bunker | 248/628 |
| 3,042,448 | A | | 7/1962 | Hamilton | |
| 3,096,121 | A | | 7/1963 | Knabusch et al. | |
| 3,287,059 | A | | 11/1966 | Rosmarin | |
| 3,295,885 | A | | 1/1967 | Barksdale | |
| 3,475,051 | A | | 10/1969 | Crawford | |
| 3,802,735 | A | | 4/1974 | Re | |
| 4,183,494 | A | | 1/1980 | Cleveland | |
| 4,212,495 | A | | 7/1980 | Gall | |
| 4,437,701 | A | | 3/1984 | Mizelle | |
| 4,810,032 | A | | 3/1989 | Gibson | |
| 4,871,208 | A | * | 10/1989 | Hodgdon | 297/303.1 |
| 5,104,181 | A | | 4/1992 | Lange | |
| 5,121,966 | A | | 6/1992 | Tischler | |
| 5,171,000 | A | | 12/1992 | LaPointe et al. | |
| 5,227,095 | A | * | 7/1993 | Curtis | 261/30 |
| 5,301,413 | A | | 4/1994 | Habegger et al. | |
| 5,328,235 | A | * | 7/1994 | Saul et al. | 297/270.1 |
| 5,370,442 | A | | 12/1994 | Saul et al. | |
| 5,567,009 | A | | 10/1996 | Fay et al. | |
| 5,649,740 | A | * | 7/1997 | Hodgdon | 297/303.1 |
| 5,738,409 | A | | 4/1998 | Bursik | |
| 6,116,687 | A | * | 9/2000 | Vogtherr | 297/300.1 |
| 6,231,120 | B1 | | 5/2001 | Wiecek | |
| 6,347,835 | B1 | * | 2/2002 | LaPointe et al. | 297/440.1 |
| 6,557,934 | B2 | * | 5/2003 | Wiecek | 297/84 |
| 6,733,071 | B2 | | 5/2004 | Guillot et al. | |
| 6,827,401 | B2 | | 12/2004 | Marshall et al. | |
| 7,275,789 | B2 | | 10/2007 | LaPointe | |
| 7,543,893 | B2 | * | 6/2009 | LaPointe | 297/463.1 |
| 2005/0067867 | A1 | * | 3/2005 | May | 297/270.1 |
| 2006/0232113 | A1 | * | 10/2006 | Hale et al. | 297/258.1 |
| 2007/0040419 | A1 | * | 2/2007 | LaPointe et al. | 297/69 |
| 2007/0241599 | A1 | * | 10/2007 | Hodgdon | 297/313 |
| 2009/0033129 | A1 | * | 2/2009 | Marshall | 297/69 |

* cited by examiner

*Primary Examiner* — David R Dunn

(57) ABSTRACT

A rocking furniture member includes an occupant support member supporting an occupant of the furniture member. A frame is connected to the occupant support member and supports the seat portion for rocking motion with respect to a furniture member support surface. An elastically resilient member connecting the occupant support member to the frame permits occupant induced rocking motion of the occupant support member with respect to the support surface. The resilient member is a monolithic bar having a uniform cross section.

2 Claims, 9 Drawing Sheets

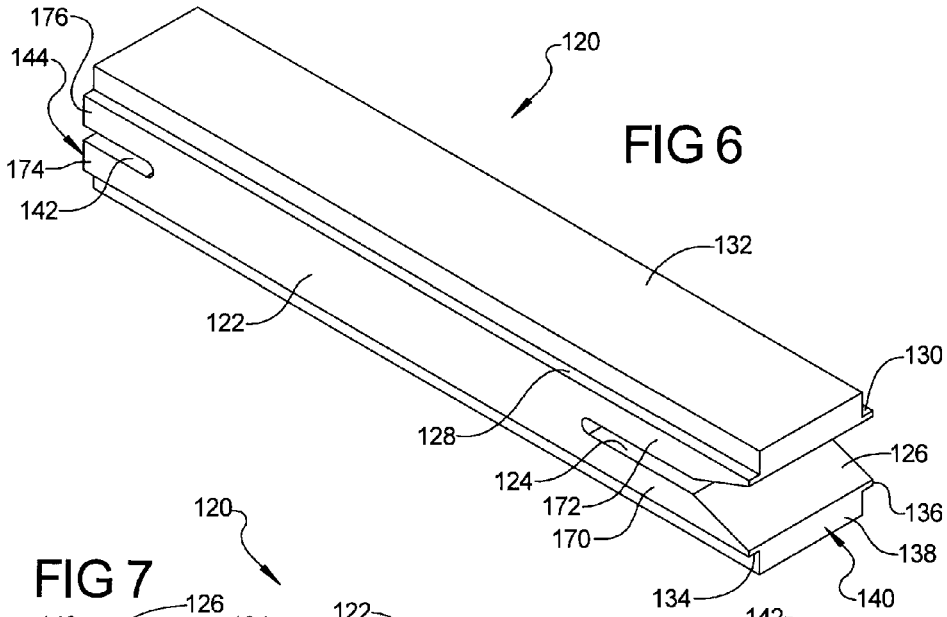
FIG 6
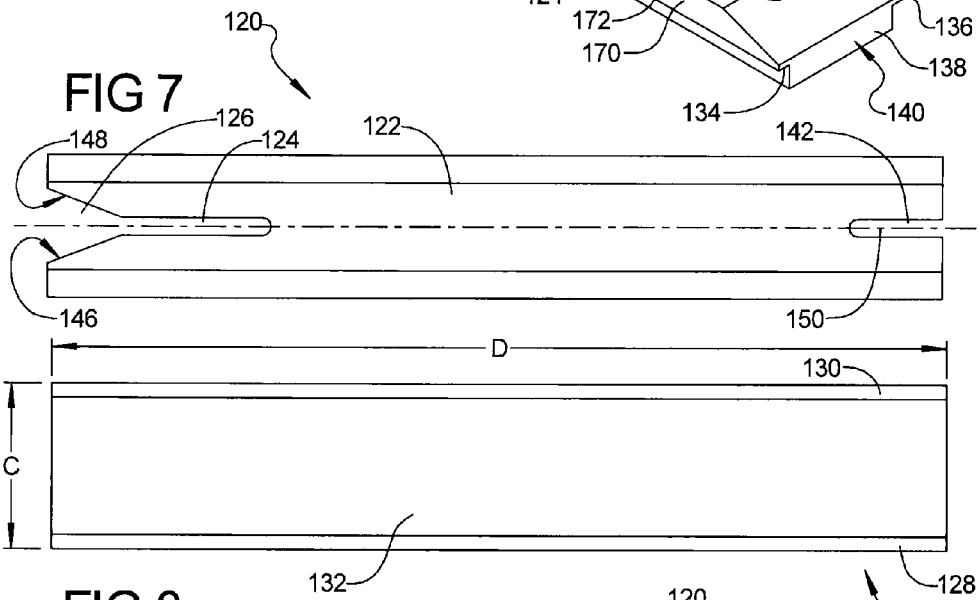
FIG 7
FIG 8
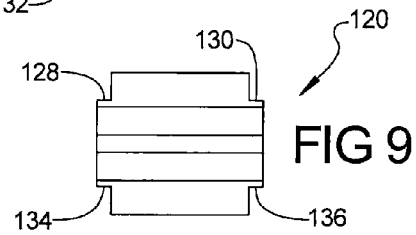
FIG 9

RESILIENT ROCKING ELEMENT FOR FURNITURE MEMBER

FIELD

The present disclosure relates to biasing elements used to permit rocking motion of a furniture member.

BACKGROUND

This section provides background information related to the present disclosure which is not necessarily prior art.

Furniture members such as chairs, loveseats, sofas, and the like commonly include a mechanism that permits reclining motion, extension and retraction of a leg rest assembly, and/or a rocking motion, defined as a forward and backward motion from the perspective of an occupant of the furniture member. To permit rocking motion, common furniture members include wooden side members having surfaces with a predetermined arc or radius of curvature that define the arc of rocking motion of the furniture member, leaf springs, or one or more coiled springs having at least one coil member that axially extend and compress, angularly deflect, twist, or a combination of these motions to allow the furniture member to rock backwards and forwards within a predefined angular range of motion. When used, coiled springs are commonly made of a material such as spring steel having elastic properties so the furniture member will return after rocking to a neutral or non-rocked position. The use of springs, however, commonly requires a spring housing to support the springs. During rocking motion, the extension and/or compression, angular deflection, and/or twisting motion of the springs causes some displacement motion between ends of the coil members and the furniture member frame or spring housing. This motion commonly creates a frictional noise and/or a spring noise that can increase over time.

SUMMARY

This section provides a general summary of the disclosure, and is not a comprehensive disclosure of its full scope or all of its features.

According to several embodiments, an elastically resilient member adapted to provide a rocking motion for a furniture member includes an elastically resilient material member body positioned between first and second portions of the furniture member to permit the first portion to rock forwardly and rearwardly with respect to the second portion. The body is created in a monolithic form.

According to further embodiments, a rocking furniture member includes an occupant support member adapted to support an occupant of the furniture member. A frame is connected to the occupant support member and supports the seat portion for rocking motion with respect to a furniture member support surface. An elastically resilient member connects the occupant support member to the frame permitting occupant induced rocking motion of the occupant support member with respect to the support surface. The resilient member is monolithic having a substantially uniform cross section throughout.

According to still other embodiments, a rocking furniture member includes an actuation mechanism operating to extend and retract a leg rest assembly and to rotate a seat back member. The actuation mechanism is connected to a first planar flange. An elastically resilient member is connected to the actuation mechanism permitting an occupant induced rocking motion of the actuation mechanism with respect to a floor surface. The resilient member defines a monolithic bar shape. A frame connected to the resilient member has a second planar flange. The resilient member is positioned between the first planar flange of the actuation mechanism and the second planar flange of the frame to permit the actuation mechanism to rock with respect to the frame by elastic deflection of the resilient member.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

FIG. 6 is a front perspective view of a further embodiment of a resilient rocking element of the present disclosure;

FIG. 7 is a side elevational view of the resilient rocking element of FIG. 6;

FIG. 8 is a top plan view of the resilient rocking element of FIG. 6;

FIG. 9 is a front elevational view of the resilient rocking element of FIG. 6;

Corresponding reference numerals indicate corresponding parts throughout the several views of the drawings.

DETAILED DESCRIPTION

Figure 1:
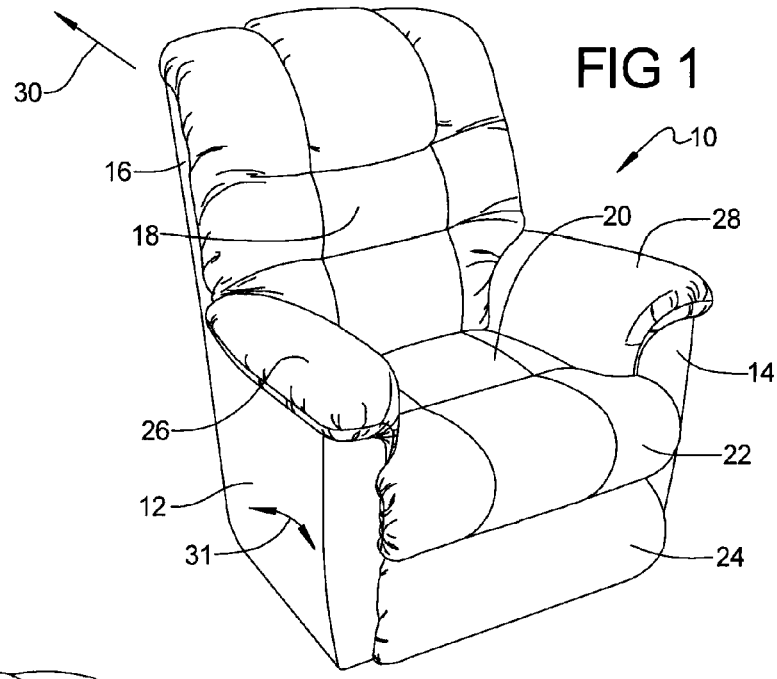
FIG. 1 is a front right perspective view of a furniture member having the resilient rocking element of the present disclosure.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a", "an" and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on", "engaged to", "connected to" or "coupled to" another element or layer, it may be directly on, engaged, connected or coupled to the other element or layer, or intervening elements or layers may be present. In contrast, when an element is referred to as being "directly on," "directly engaged to", "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath", "below", "lower", "above", "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Figure 12:
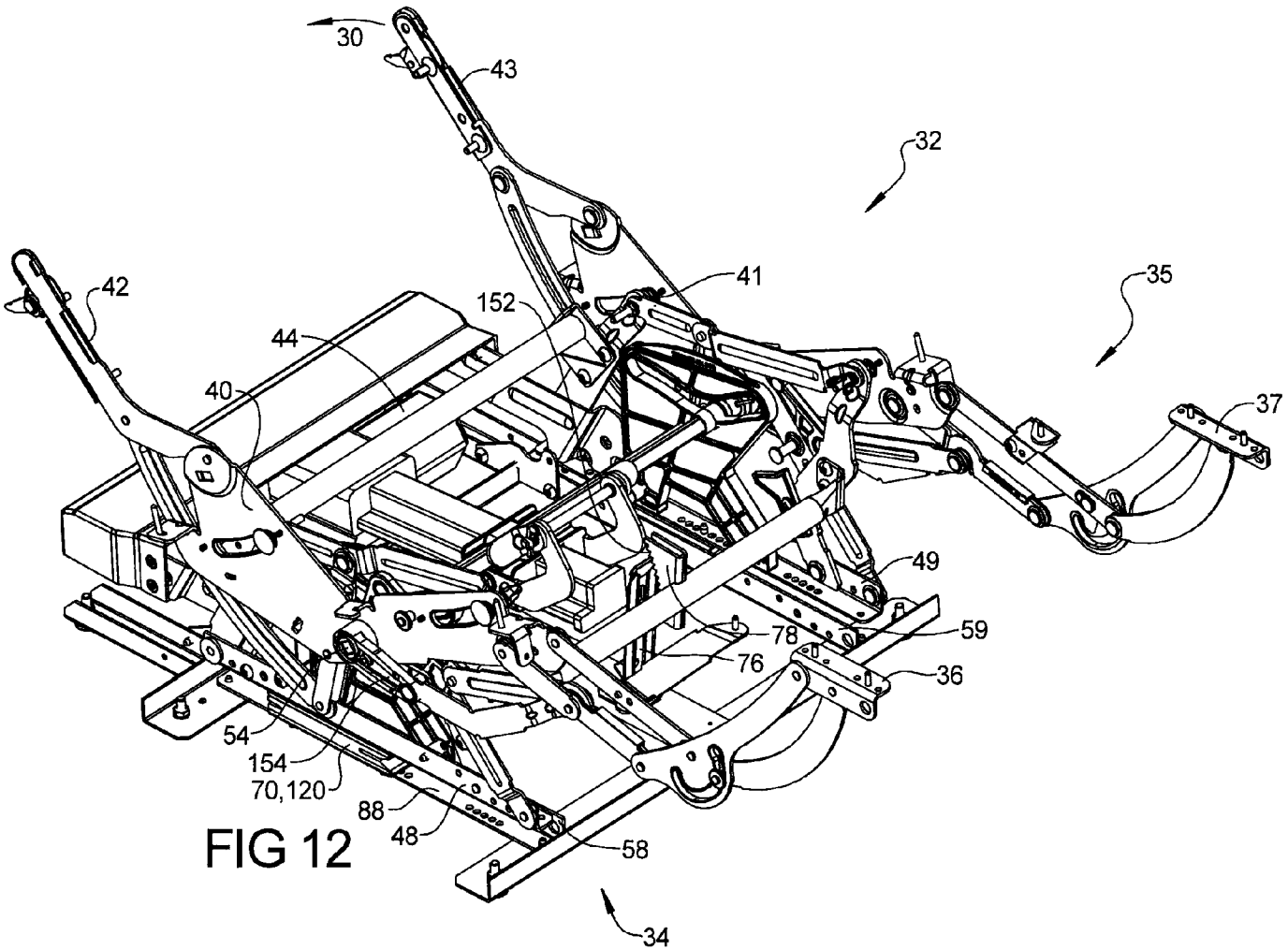
FIG. 12 is a front right perspective view of the mechanism of FIG. 3 shown in a leg rest fully extended and a seat back fully rotated position.

Referring generally to FIG. 1, a furniture member 10 depicted as a reclining chair includes first and second sides 12, 14 and an occupant seat back 16 covered with a seat back cushion assembly 18. An occupant support member 20 is suspended between the first and second sides 12, 14 and a padded leg support 22 is also provided. A padded, extendable leg rest assembly 24 is also provided. First and second arm rest pads 26, 28 can be used to cover the upper surfaces of the first and second sides 12, 14 respectively. An occupant's weight generally centered on support member 20 is normally operable to maintain seat back 16 in an upright position. When the leg rest assembly 24 is positioned in a stowed or retracted position shown, seat back 16 can be manually reclined or rotated with respect to a seat back arc of rotation 30. Seat back 16 can also rotate about arc of rotation 30 after leg rest assembly 24 reaches a fully extended position shown and described with reference to FIGS. 12 and 13. In a powered version of furniture member 10, seat back 16 returns to the upright position shown and opposite to seat back arc of rotation 30 when a command is given by the occupant to return leg rest assembly 24 from a fully extended position to the fully retracted position shown. In manually operated furniture members 10, seat back 16 can be returned to the upright position shown and opposite to seat back arc of rotation 30 when the occupant shifts his or her weight forward. According several embodiments, furniture member 10 can independently rotate or rock forward and rearward about a furniture member arc of rotation 31 by motion induced by the occupant and without requiring powered operation.

In the embodiment shown, furniture member 10 is depicted as an upholstered chair, however the present teachings are not limited to upholstered chairs. Furniture member 10 can be any of a plurality of furniture members, including, but not limited to single or multiple person furniture members, chairs having limited or no upholstery, sofas, sectional members and/or loveseats.

Figure 2:
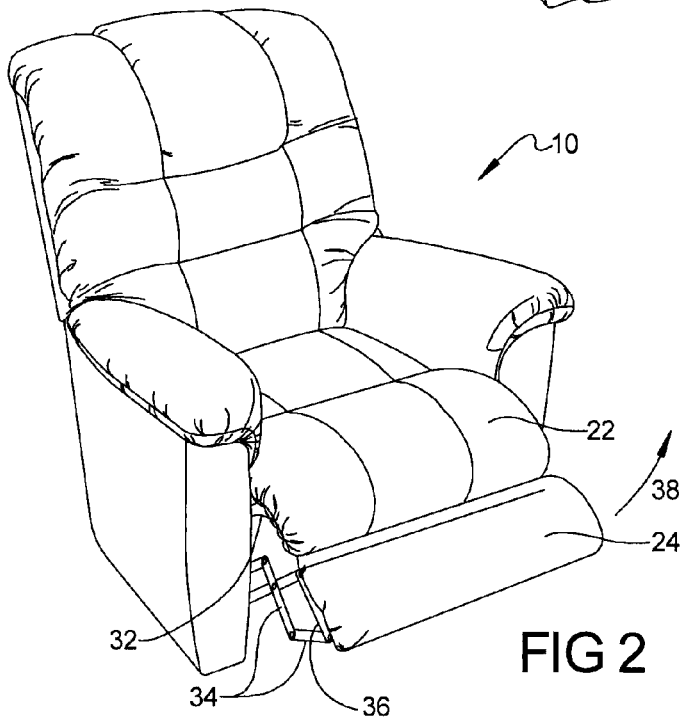
FIG. 2 is the front right perspective view of FIG. 1 further showing a leg rest assembly in an extended position.

Referring generally to FIG. 2, an actuation mechanism 32 can be manually or automatically actuated by either a manual actuation motion or an electronically forwarded command from the occupant to direct the repositioning of leg rest assembly 24 from the stowed position (shown in FIG. 1) to an extended position. Actuation mechanism 32 supports and permits both extension and retraction of leg rest assembly 24, as well as rotation of seat back 16. More specifically, actuation mechanism 32 includes first and second pantograph linkage sets 34, 35 (second pantograph linkage set 35 is not visible in this view) which are linked to leg rest assembly 24 using first and second leg rest support arms 36, 37 (only first leg rest support arm 36 is visible in this view). Leg rest assembly 24 can be moved from the fully retracted position (shown in FIG. 1) to an extended position by motion of the leg rest assembly 24 about an extension arc 38. It will be apparent that rotation of leg rest assembly 24 in an opposite direction from extension arc 38 will return the leg rest assembly 24 to the retracted position.

Figure 3:
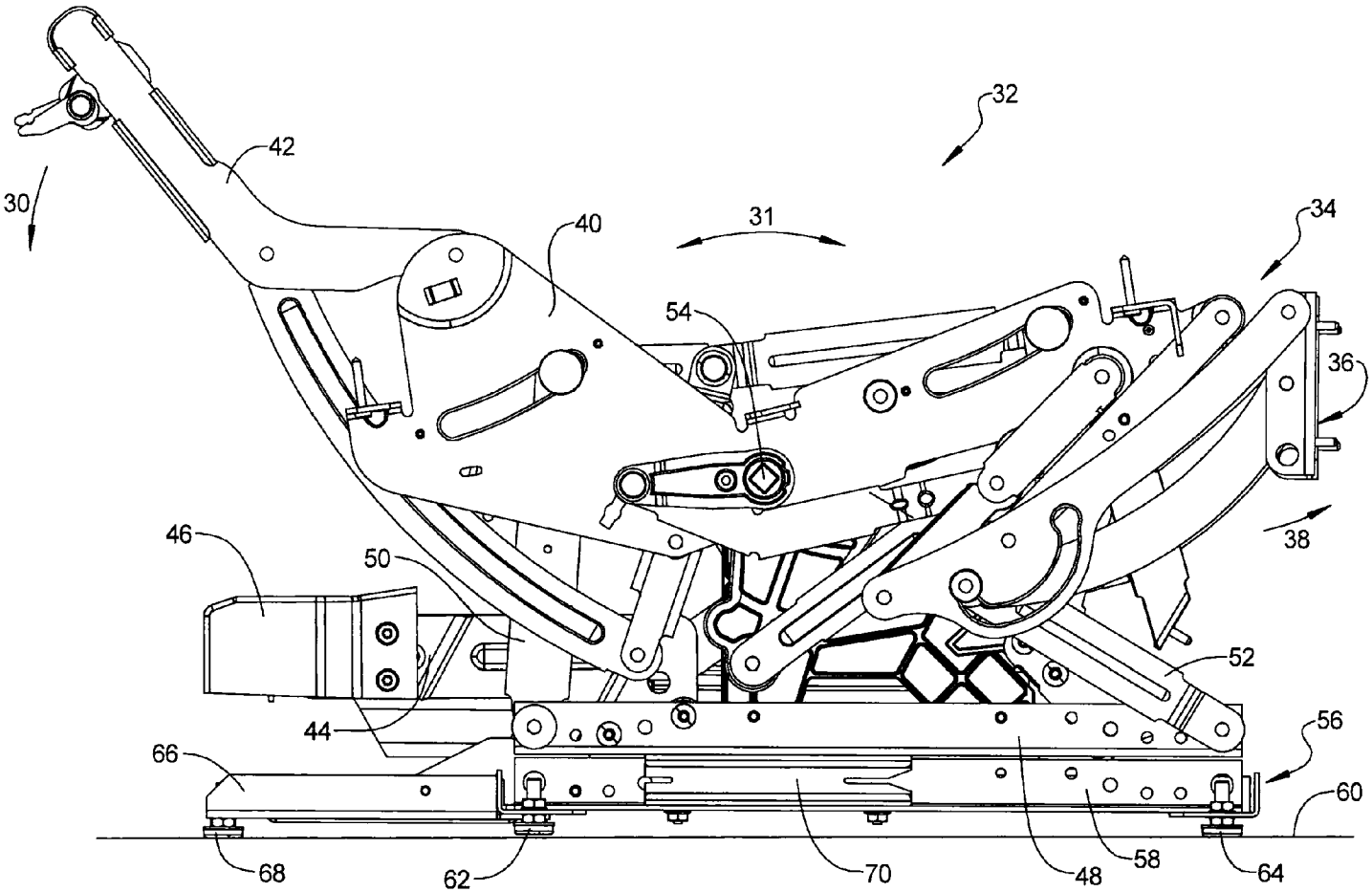
FIG. 3 is a right side elevational view of a furniture mechanism having the resilient rocking element of the present disclosure, with the mechanism in a fully retracted condition.

Referring to FIG. 3, with the actuation mechanism shown in the leg rest stowed and seat back fully upright positions, actuation mechanism 32 can rotate forwardly or rearwardly about the furniture member arc of rotation 31. First and second mechanism side members 40, 41 (second mechanism side member is not clearly visible in this view) provide structural support for the various linkage members such as first and second leg rest support arms 36, 37 of first and second pantograph linkage sets 34, 35. First and second seat back connecting links 42, 43 are each individually connected to one of the first and second mechanism side members 40, 41. The first and second seat back connecting links 42, 43 are each capable of movement in the seat back arc of rotation 30.

According to several embodiments, a power drive assembly 44 can be provided with actuation mechanism 32. A drive assembly cover 46 provides a cover or shield for the rearwardly extending portions of power drive assembly 44. All of the various linkage members connected to and supported by the first and second mechanism side members 40, 41 are rotatably connected to first and second side support members 48, 49 (second side support member 49 is not clearly visible in this view) by rear support link 50 and front support link 52. The first and second pantograph linkage sets 34, 35, as well as first and second seat back connecting links 42, 43 are rotatably extended or retracted by axial rotation of a drive rod 54. Drive rod 54 is rotatably connected to each of first and second mechanism side members 40, 41. First and second side support members 48, 49 are each rotatably connected to a frame shown generally as frame support structure 56 by first and second lateral frame members 58, 59 (second lateral frame member 59 is not clearly visible in this view).

Frame support structure 56 provides direct support of the furniture member to a floor surface 60 using each of a rear adjustable height leg 62, a front adjustable height leg 64, a frame extension member 66 extending rearwardly of frame support structure 56, and a frame extension adjustable height leg 68. Each of the rear, front, and frame extension adjustable height legs 62, 64, 68 permit the frame support structure 56 to be oriented substantially parallel with floor surface 60, as well as providing for load and weight distribution of both the actuation mechanism 32 and the occupant of the furniture member. First and second side support members 48, 49 are rotatably connected to first and second lateral frame members 58, 59 by oppositely positioned first and second elastically resilient members 70, 70' (second elastically resilient member 70' is not visible in this view). Forward and rearward rocking motion with respect furniture member arc of rotation 31 is entirely achieved by elastic deflection of first and second elastically resilient members 70, 70' which also provide an elastic biasing force to return actuation mechanism 32 to the neutral position shown when an occupant force inducing rocking motion is removed.

Figure 4:
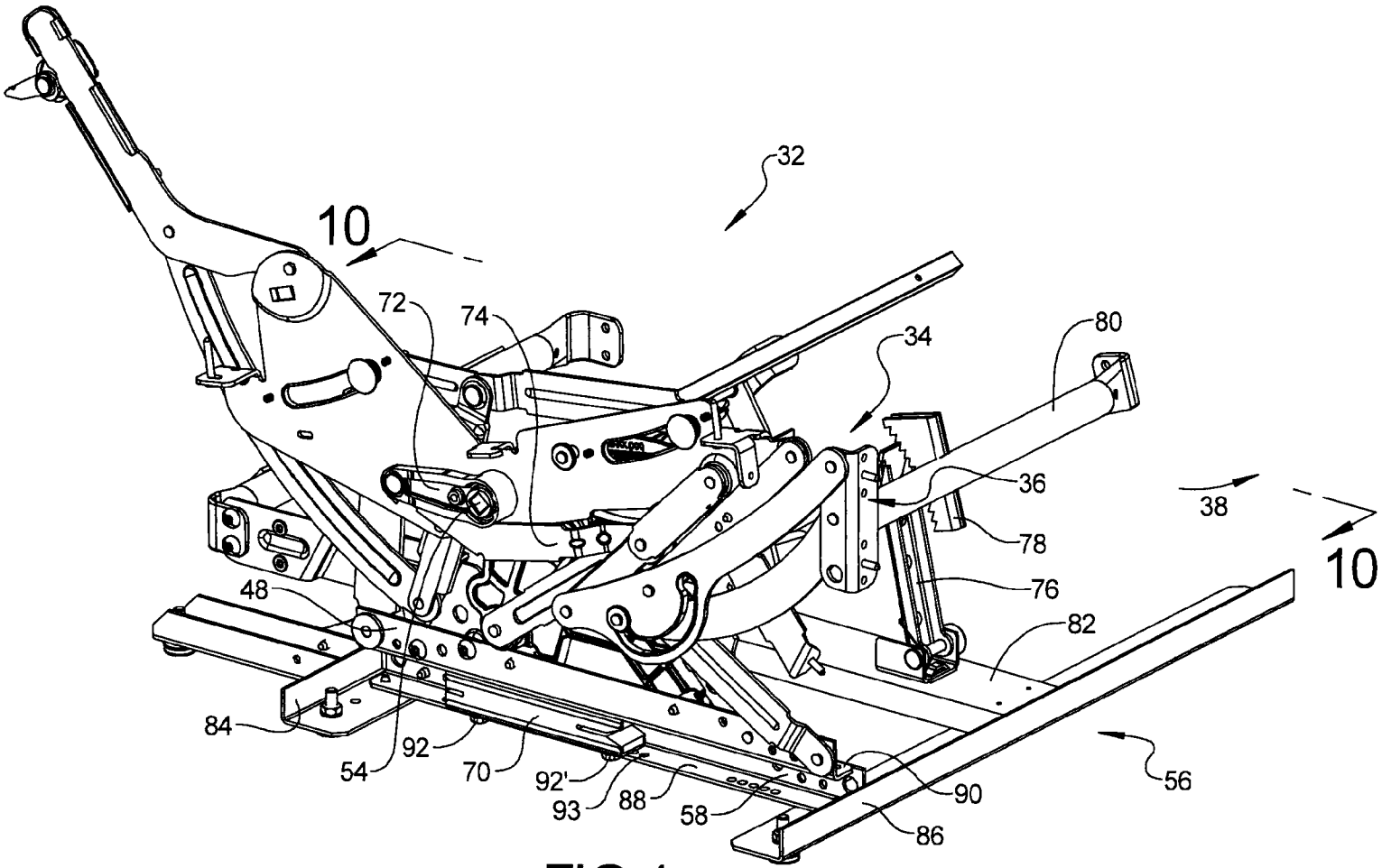
FIG. 4 is a right front perspective view of the mechanism of FIG. 3.

Referring to FIG. 4, only the right-hand side of actuation mechanism 32 is shown. The left-hand side is a mirror image configuration having duplicate but oppositely oriented parts which will therefore not be described further herein. A leg rest lock link 72 is connected to drive rod 54 such that rotation of drive rod 54 co-rotates leg rest lock link 72 and thereby an extension link 74 to extend or retract first pantograph linkage set 34 as well as first leg rest support arm 36. In a neutral or non-rocked position of actuation mechanism 32 shown, a pawl 76 is spatially separated from a ratchet 78 to allow free rotation in the forward and rearward directions of actuation mechanism 32 by deflection of elastically resilient member 70. Ratchet 78 is fixed to a front cross support member 80 and pawl 76 is rotatably supported to a central lateral frame member 82 of frame support structure 56.

Frame support structure 56 also includes a rear cross frame member 84 and a front cross frame member 86 providing lateral rigidity to frame support structure 56. Elastically resilient member 70 can be positioned between and fastenably connected to each of a first planar flange 88 of first lateral frame member 58 and a second planar flange 90 of first side support member 48. A plurality of fastener nuts 92 are fastenably secured to fasteners (not clearly visible in this view) which are received through pre-determined ones of a plurality of apertures 93 created in first planar flange 88 and similarly created in second planar flange 90. The forward and rearward positioning of elastically resilient member 70 can be adjusted by positioning the fasteners in various ones of the apertures 93 that fix the location of elastically resilient member 70. This provides a capability of tuning or adjusting the amount of rotation of actuation member 32 to suit the design requirements of various ones of the actuation mechanisms 32.

Figure 5:
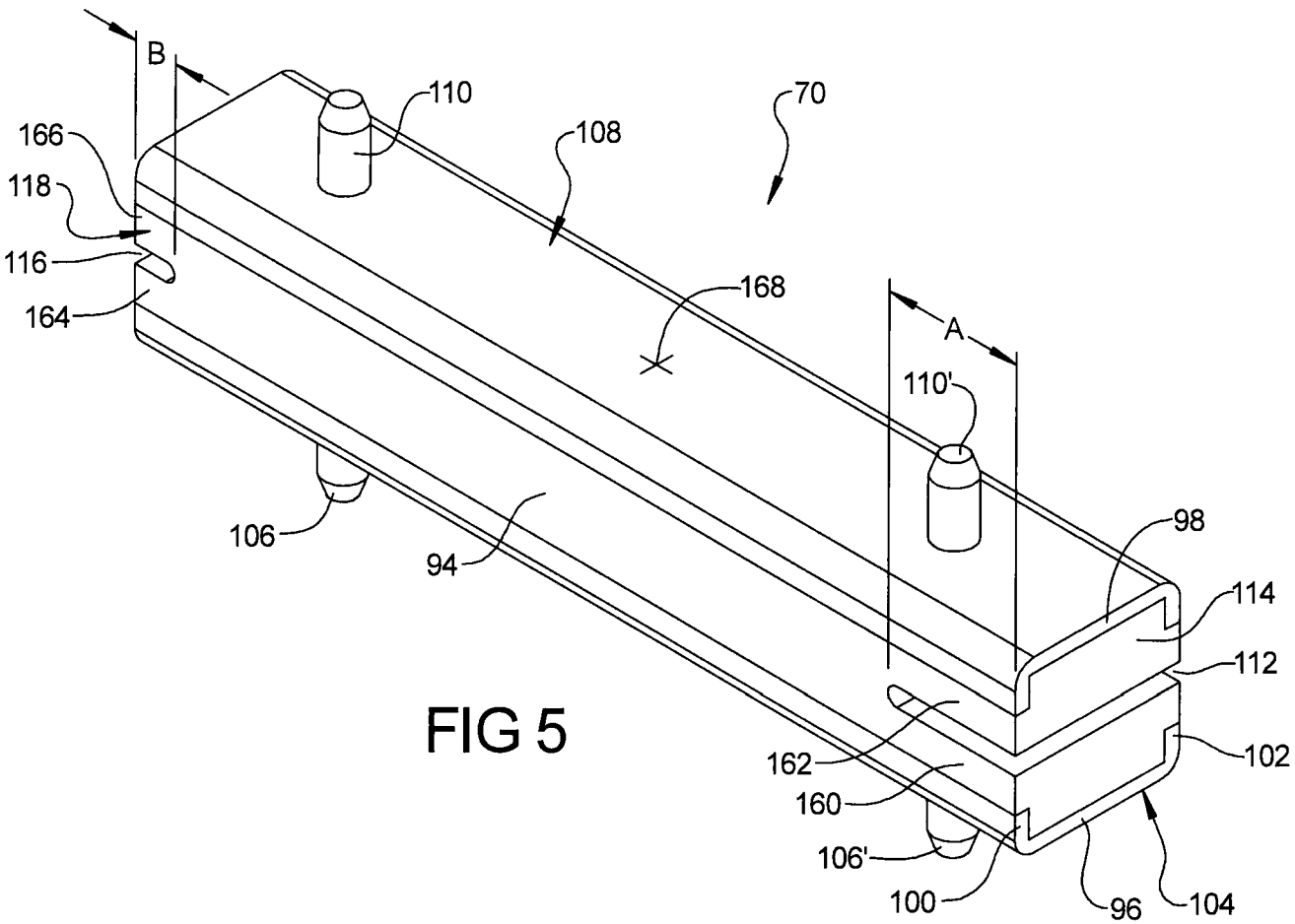
FIG. 5 is a front perspective view of a resilient rocking element of the present disclosure.

Referring to FIG. 5, according to several embodiments elastically resilient member 70 can include a resilient member body 94 having a bar shape which according to several embodiments defines a generally rectangular shape. A material of resilient member body 94 can be a rubber or a synthetic polymeric material having elastic properties which allow elastically resilient member 70 to elastically deflect and expand as required to allow the rocking motion of the furniture member. As shown in FIG. 5, positioned both above and below resilient member body 94 is each of a first and second body containment member 96, 98 which according to several embodiments are each constructed of a substantially rigid material such as a metal including steel or stainless steel, or a rigid polymeric material. Each of the first and second body containment members 96, 98 include a first and second containment member outer wall 100, 102 which laterally retain the resilient member body 94 therebetween. A first planar surface 104 is provided by first body containment member 96 which can have at least one, and according to several embodiments, two fasteners 106, 106' extending substantially transverse with respect to first planar surface 104. Oriented substantially parallel to first planar surface 104 is a second planar surface 108 defined by second body containment member 98. At least one, and according to several embodiments, two fasteners 110, 110' extend substantially transverse with respect to second planar surface 108. Fasteners 106, 106' and 110, 110' can have threaded shanks and be permanently fixed to either first or second body containment member 96, 98.

Resilient member body 94 further includes a first body dividing slot 112 created at a first end 114 and an oppositely positioned second body dividing slot 116 created at a second end 118. Each of the first and second body dividing slots 112, 116 are both co-planar and co-axial and are oriented substantially parallel to first and second planar surfaces 104, 108. According to several embodiments a first slot depth "A" of first body dividing slot 112 can be equal to or greater than a second slot depth "B" of second body dividing slot 116. The depth of the various first and second body dividing slots 112, 116 allow the manufacturer to control the force required to rock the furniture member either forwardly or rearwardly as well as limiting a total amount of rocking motion. First and second body dividing slots 112, 116 can also be eliminated at the discretion of the manufacturer if this additional amount of deflection control is not required. Referring back to FIG. 4, elastically resilient member 70 is fastened, for example by connecting fastener nuts 92, 92' to each of the fasteners 106, 106'. Similar nuts are also engaged with fasteners 110, 110' (not visible in FIG. 4). Because fastener 106 is not connected to or structurally part of fastener 110, and fastener 106' is similarly not structurally connected to fastener 110', there is no through-extension of the fasteners through resilient member body 94. This permits resilient member body 94 to expand or contract upon receiving the rotation load of the furniture member without limitation of the fasteners.

Referring to FIG. 6 and again to FIG. 5, according to several embodiments, an elastically resilient member 120 can be used in place of elastically resilient member 70. Elastically resilient member 120 includes several features common to elastically resilient member 70 and several features which are different. A resilient member body 122 of elastically resilient member 120 includes a first body dividing slot 124 which opens into a tapered slot opening 126. Tapered slot opening 126 permits a greater degree of compression at one end of elastically resilient member 70 than provided by the first body dividing slot 112 alone. Elastically resilient members 70 and 120 each include a first body flange 128 oppositely positioned with respect to a second body flange 130 of a first planar body portion 132. Similarly, a third body flange 134 and a fourth body flange 136 are created in a second planar body portion 138. First body dividing slot 124 and tapered slot opening 126 are each created at a first body end 140. A second body dividing slot 142 created at a second body end 144 is oppositely positioned with respect to first body dividing slot 124.

Referring to FIG. 7, first body dividing slot 124 opens into tapered slot opening 126 by the creation of oppositely oriented first and second tapered slot faces 146, 148. Each of the first body dividing slot 124, tapered slot opening 126, and second body dividing slot 142 are co-axially positioned with respect a longitudinal axis 150 of resilient member body 122.

Referring to FIG. 8, elastically resilient member 120 has a body width "C" and a body length "D" which can each be greater than or less than similar dimensions used for elastically resilient member 70. The body length "D" is generally greater than body width "C" and can be adjusted to increase or decrease an degree of forward and rearward angular rotation of the furniture member while the body width "C" can be increased or decreased to control a stiffness and a total weight/load carrying capability of elastically resilient member 120.

Referring to FIG. 9, each of first and second body flanges 128, 130 are co-planar with each other and are parallel to third and fourth body flanges 134, 136. A width of each of the first, second, third, and fourth body flanges 128, 130, 134, 136 is substantially equal and is determined by a corresponding width of the first and second containment member outer walls 100, 102 shown and described with reference to FIG. 5.

Figure 10:
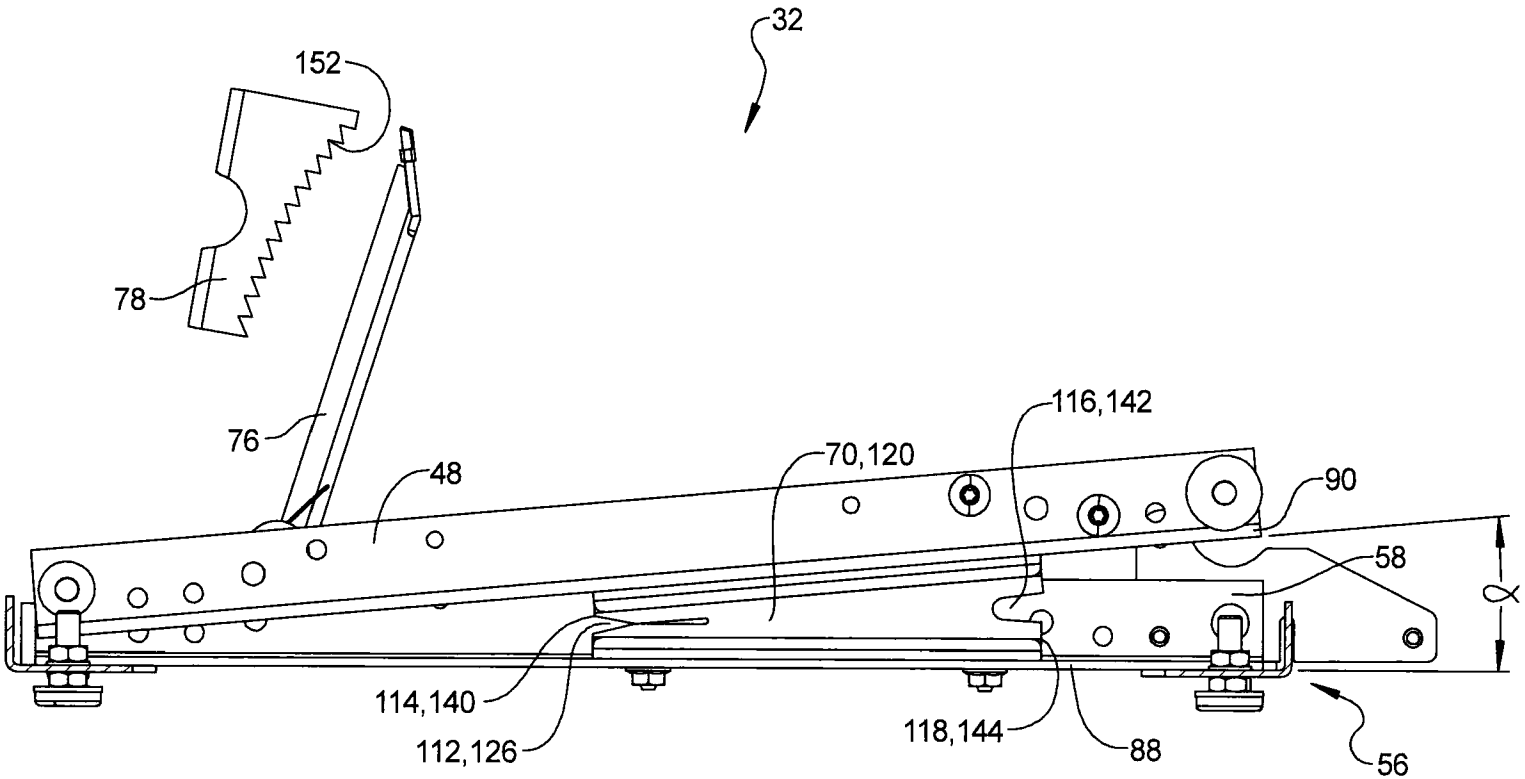
FIG. 10 is a partial perspective view taken at section 10 of FIG. 4 showing a rearward rocked condition of the mechanism.

Referring to FIG. 10, a maximum forward rocked position of actuation mechanism 32 is defined by an angle alpha ($\alpha$) between second planar flange 90 and first planar flange 88. Deflection of either of the elastically resilient member 70 or the elastically resilient member 120 are similar, therefore, both will be described herein. As actuation mechanism 32 rotates forwardly, the height of first body dividing slot 112, 126 of elastically resilient member 70, 120 is reduced substantially to zero as contact occurs at first end 114 or first end 140. At the same time, the second body dividing slot 116 or 142 expands to a maximum spacing proximate to second end 118 or second body end 144. During the forward rocking rotation movement, pawl 76 remains clear of a plurality of teeth 152 of the ratchet 78 allowing free forward rotation of actuation mechanism 32.

Figure 11:
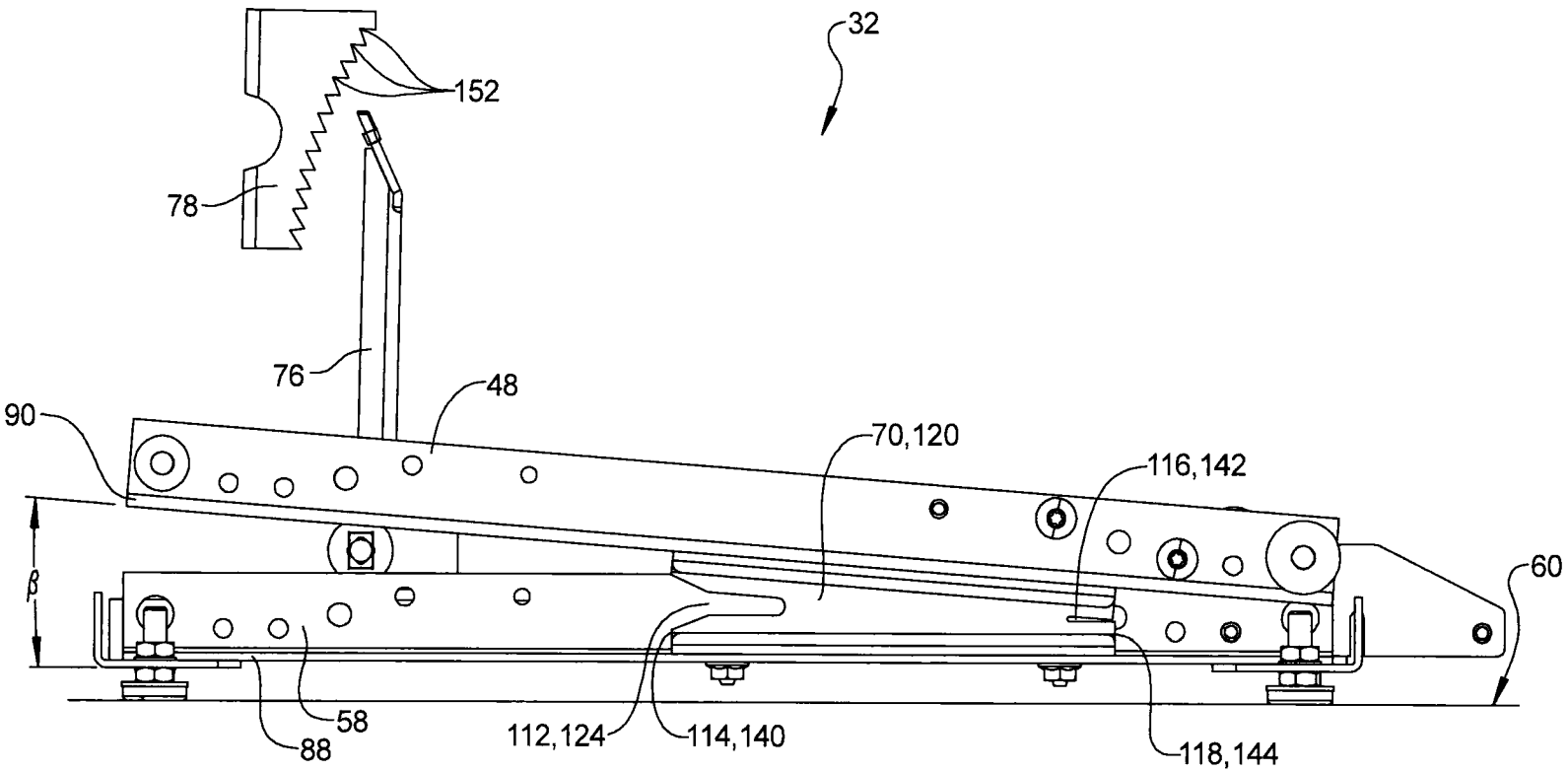
FIG. 11 is the partial perspective view of FIG. 10 modified to show a forward rocked condition of the mechanism.

Referring to FIG. 11, a full rearward rocked position of actuation mechanism 32 is created when an angle beta ($\beta$) is created between second planar flange 90 and first planar flange 88 as the second body dividing slot 116 or 142 closes. At the same time, a maximum spacing is created between first body dividing slot 112, 124 proximate to the first end 114 or first body end 140 of elastically resilient member 70, 120. During rearward rotation of actuation mechanism 32, pawl 76 remains clear of the teeth 152 of ratchet 78. During either forward or rearward rotation of actuation mechanism 32, first planar flange 88 of first lateral frame member 58 remains substantially parallel to floor surface 60.

Referring to FIG. 12 and again to FIG. 3, for a powered furniture member a fully extended position of first and second pantographic linkage sets 34, 35 is provided when a toggle stop 154 is rotated to the forward facing orientation shown in FIG. 12 from the rearward-facing orientation shown in FIG. 3. This occurs as drive rod 54 is axially rotated. Once the fully extended position of first and second pantographic linkage sets 34, 35 is achieved, the first and second seat back connecting links 42, 43 can begin their rearward rotation about seat back arc of rotation 30. During the entire period of rotation of drive rod 54, pawl 76 moves upward, engaging successive ones the teeth 152 of ratchet 78 thereby preventing further rocking motion of actuation mechanism 32 with respect to either elastically resilient member 70 or elastically resilient member 120. Deflection of either elastically resilient member 70 or 120 can still occur, however, rocking motion is precluded by ratchet 78 contacting any one of teeth 152. Rotation of drive rod 54 occurs when power drive assembly 44 is actuated by the occupant of the furniture member.

Reversing the operation of power drive assembly 44 reverses the order or sequence of operation for actuation mechanism 32. During reverse operation, first and second seat back connecting links 42, 43 rotate in an opposite direction with respect to seat back arc of rotation 30 until the first and second seat back connecting links 42, 43 return to the fully upright position. After the fully upright position is reached, continued axial rotation of drive rod 54 rotates toggle stop 154 to return the first and second pantograph linkage sets 34, from the fully extended position shown to a fully retracted position shown and described with reference to FIG. 3.

Figure 13:
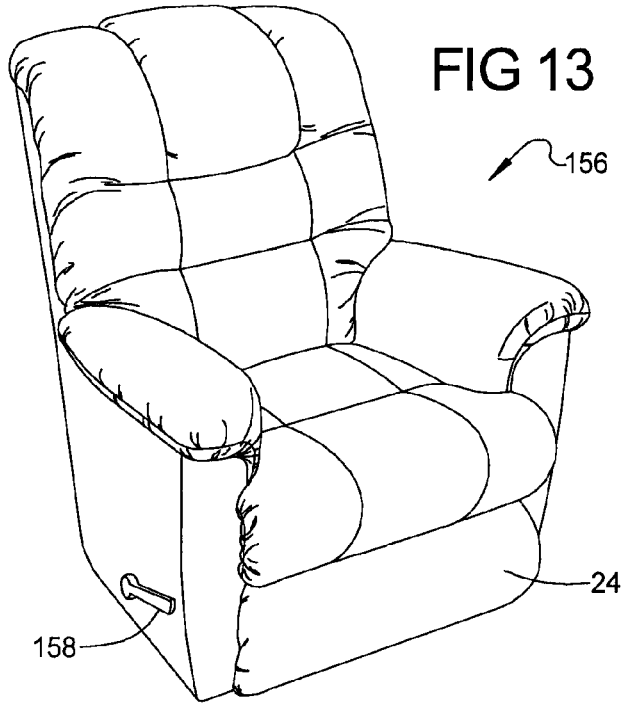
FIG. 13 is a front right perspective view of a furniture member having a manual actuation device to actuate the leg rest assembly and seat back.

Referring to FIGS. 13 and 14, and again to FIG. 3, according to several embodiments, a furniture member 156 is modified from furniture member 10 by eliminating the power drive assembly 44 and relying instead on manual rotation of drive rod 54. The fully reclined position of leg rest assembly 24 is shown in FIG. 13. An actuation lever 158 is connected to drive rod 54 and rotatably positioned as shown in the leg rest fully retracted position. Rocking motion of furniture member 156 can occur with actuation lever 158 located as shown.

Figure 14:
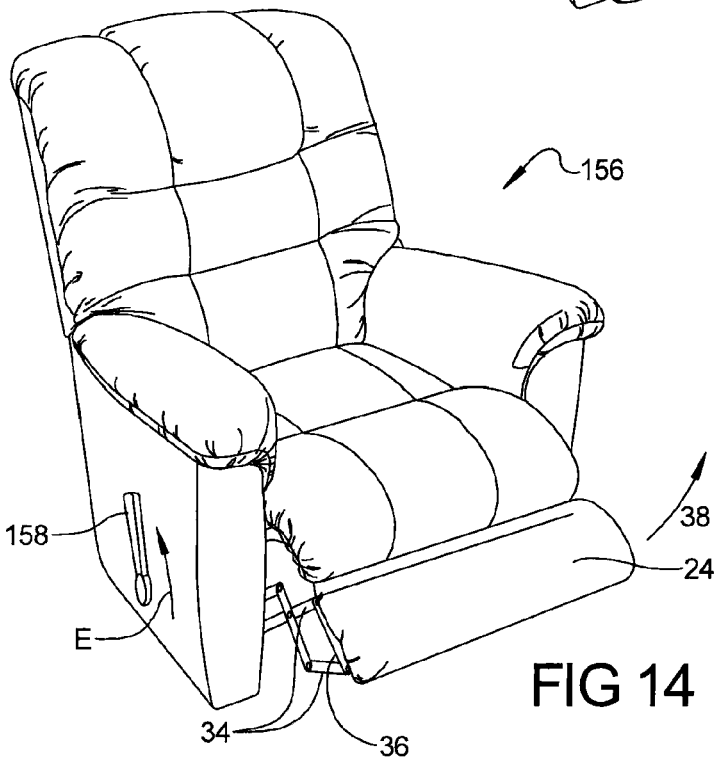
FIG. 14 is the front right perspective view of FIG. 13 further showing the leg rest assembly in the extended position.

Referring more specifically to FIG. 14, as actuation lever 158 is rotated about an arc of rotation "E", leg rest assembly 24 is rotated in the leg rest extension arc 38 by extension of first and second pantograph linkage sets 34, 35 (only first pantograph linkage set 34 is visible in this view), and rotation of first and second leg rest support arms 36, 37 (only first leg rest support arm 36 is visible in this view). Actuation lever 158 rotation about arc of rotation "E" continues until leg rest assembly 24 reaches the fully extended position. Upon initial rotation of actuation lever 158 rocking motion of furniture member 156 is thereafter precluded. Additional manual operating devices (not shown) can also be used to replace actuation lever 158, such as but not limited to, release latches, push button operators, and the like. All of the various embodiments disclosed herein for the various furniture members are provided with the capability of forward and rearward rocking motion by use of the elastically resilient members described herein with either an automatically operated actuation mechanism or a manually operated actuation mechanism.

According to several embodiments, rocking furniture members 10 and 156 include an occupant support member 20 supporting an occupant of the furniture member. The frame 56 is connected to the occupant support member 20 and supports the occupant support member 20 for rocking motion with respect to furniture member support surface 60. Elastically resilient member 70 or 120 connects the occupant support member 20 to frame 56 permitting occupant induced rocking motion of the occupant support member 20 with respect to the support surface 60.

According to several embodiments, rocking furniture members 10 and 156 include actuation mechanism 32 operating to extend and retract leg rest assembly 24 and to rotate seat back member 16. The actuation mechanism 32 is connected to a first planar flange 88. Elastically resilient member 70 or 122 is connected to the actuation mechanism 32 permitting an occupant induced rocking motion of the actuation mechanism with respect to floor surface 60. The resilient member 70 or 122 defines a monolithic bar shape. A frame 56 connected to the resilient member has a second planar flange 90. The resilient member 70 or 122 is positioned between the first planar flange 88 of the actuation mechanism 32 and the second planar flange 90 of the frame 56 to permit the actuation mechanism 32 to rock with respect to the frame 56 by elastic deflection of the resilient member 70 or 122.

The resilient member bodies 94, 122 of resilient members 70 and/or 120 are substantially "monolithic" in form, defined herein as being made of a single piece or molding, or multiple fixedly connected layers of resilient material, having few or no internal voids, and no extending portions such as coils having voids between the coils to provide for compression between coils. Voids in the monolithic form are permissible providing the resilient members 70 or 120 can support the combined weight of the actuation mechanism 32 and the weight of the furniture member occupant. Each resilient member 70 or 120 is substantially bar or block shaped, having a length greater than a width or thickness, and having no coil members. According to further embodiments, the bar or block shape can include a length equal to a width or thickness. The bar or block shape of resilient members 70 and/or 120 can have a square, rectangular, oval, circular, polygonal, rhomboid, trapezoid, or the like shape in cross section, and can include body dividing slots 112, 116, 124, 142 at one or at both ends to provide increased local areas of expansion or compression of the resilient member during rocking motion. According to additional embodiments it is contemplated that two or more layers of the same or of different resilient materials can be combined to create a resilient member body within the scope of the present disclosure, having successive layers fixedly connected for example using an adhesive, heat bonding, or similar process. According to further embodiments, with the exception of localized body dividing slots 112, 116, 124, 142, a cross-sectional area and shape of the resilient member bodies 94, 122 is uniform throughout a length of the resilient member bodies.

Referring again to FIGS. 5, 6 and 3, the resilient member 70, 120 includes a first horizontal slot 112, 124 created at a first end 114, 140 separating first and second portions 160, 162 of the first end 114, 140. The resilient member 70, 120 further includes a second horizontal slot 116, 142 created at a second end 118, 144 separating third and fourth portions 164, 166, or 174, 176 of the second end 118, 144. The first horizontal slot 112, 124 created at the first end 114, 140 permits the first and second portions 160, 162 or 170, 172 to elastically displace toward each other during a first rocking motion of the furniture member and to elastically return to a neutral position (shown in FIGS. 5 and 6) in a non-rotated furniture member position (shown in FIG. 3). The second horizontal slot 116, 142 created at the second end 118, 144 permits the third and fourth portions 164, 166 or 174, 176 to elastically displace toward each other during a second rocking motion of the furniture member 10 and to elastically return to the neutral position in the non-rotated furniture member position. When the first horizontal slot 112, 124 compresses or expands during rocking motion, the second horizontal slot 116, 142 reacts in an opposite motion.

According to several embodiments, first and second body containment members 96, 98 of a substantially rigid material are oppositely positioned about and fixedly connected to the resilient member 70 or 120. At least one fastener 110 is connected to each of the first and second body containment members 96, 98. According to additional embodiments, the at least one fastener 110 comprises first and second fasteners 110, 110' individually receiving one of a first and second fastener nut 92, 92' to couple the resilient member 70 or 120 to the furniture member 10.

With further reference to FIG. 5, according to several embodiments, a rotational axis point 168 of the resilient member 70 (and a similar point for resilient member 120) defines an axis of rotation of the furniture member 10. The axis of rotation can vary from rotational axis point 168 depending on a spacing and placement of fasteners 110, 110' and the depth of first and second horizontal slots 112, 114 if used. According to additional embodiments, the rotational axis point 168 of the resilient member 70 (and the similar point for resilient member 120) only approximates an axis of rotation of the furniture member 10 due to un-even compression and limited longitudinal deflection of the resilient material body of the resilient members as the furniture member rocks.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

What is claimed is:

1. An elastically resilient member adapted to provide a rocking motion for a furniture member, comprising:

an elastically resilient material member body positioned between first and second portions of the furniture member to permit the first portion to rock forwardly and rearwardly with respect to the second portion;

the resilient member body created in a monolithic form, the resilient member body having:

first and second body flanges extending outwardly away from a first planar body portion, oppositely positioned about the resilient member body and oriented coplanar to each other; and third and fourth body flanges extending outwardly away from a second planar body portion, oppositely positioned about the resilient member body, oriented coplanar to each other and parallel to the first and second body flanges;

first and second body containment members of a substantially rigid material oppositely positioned about the resilient member; and first and second containment member outer walls, the outer walls of the first containment member received within and contacting the first and second body flanges and the outer walls of the second containment member received within and contacting the third and fourth body flanges, a width of each of the first, second, third, and fourth body flanges is substantially equal to a width of the first and second containment member outer walls.

2. The elastically resilient member of claim 1, further including at least one fastener extending from each of the first and second body containment members.

* * * * *